United States Patent [19]

Jürgensen et al.

[11] Patent Number: 4,652,106

[45] Date of Patent: Mar. 24, 1987

[54] PROCESS AND APPARATUS FOR DEVELOPING INCLUDING USE OF SOUND TRANSDUCERS

[75] Inventors: Peter J. Jürgensen, Virum; Ulrich Düdder, Hvidovre, both of Denmark

[73] Assignee: Ajax International Machinery & Metal Works A/S, Ballerup, Denmark

[21] Appl. No.: 698,353

[22] Filed: Feb. 5, 1985

[30] Foreign Application Priority Data

Feb. 13, 1984 [DK] Denmark ..... 632/84

[51] Int. Cl.[4] ..... G03D 5/04

[52] U.S. Cl. ..... 354/325; 354/328; 134/1; 134/122 P; 134/184; 134/198; 430/3

[58] Field of Search ..... 354/319, 325, 328; 134/184, 122 P, 172, 198, 199, 1; 430/3

[56] References Cited

U.S. PATENT DOCUMENTS

| | | | |
|---|---|---|---|
| 3,906,536 | 9/1975 | Graham | 354/319 |
| 4,178,188 | 12/1979 | Dussault et al. | 134/1 |
| 4,239,387 | 12/1980 | Ahrens | 354/320 |
| 4,326,553 | 4/1982 | Hall | 134/184 |
| 4,401,131 | 8/1983 | Lawson | 134/184 |
| 4,475,259 | 10/1984 | Ishii et al. | 134/184 |
| 4,515,456 | 5/1985 | Ferrante | 354/328 |
| 4,521,092 | 6/1985 | Ferrante | 354/328 |
| 4,537,511 | 8/1985 | Frei | 134/184 |

FOREIGN PATENT DOCUMENTS

| | | | |
|---|---|---|---|
| 3224210 | 1/1983 | Fed. Rep. of Germany . | |
| 1276552 | 6/1972 | United Kingdom . | |
| 2075372 | 11/1981 | United Kingdom | 354/328 |

*Primary Examiner*—A. A. Mathews

*Attorney, Agent, or Firm*—Fitch, Even, Tabin & Flannery

[57] ABSTRACT

When developing a coating such as for instance a light-sensitive exposed layer on a length or plate of material through ultrasonic agitation, the material is carried at a short distance or closely past a bar or a pipe extending substantially perpendicular to the advancing direction of the material and in the entire width of the coating. The bar or the pipe is caused to vibrate by a plurality of ultrasonic transducers while a developer is applied onto the coating adjacent the bar or the pipe in such a manner that the vibrations are transferred from the vibrating bar or pipe to the developer and to a stripe-shaped transverse area of the plate/the length including the coating. In this manner only the part of the developer having touched the ultrasonically agitated pipe or bar or already having hit the stripe of material currently developed is caused to vibrate by the ultrasonic transducers. Consequently, it is not necessary to involve an equally great power through the ultrasonic transducers as in connection with known apparatuses using a great tank with ultrasonically agitated liquid in which the entire plate/length is immersed.

10 Claims, 10 Drawing Figures

PROCESS AND APPARATUS FOR DEVELOPING INCLUDING USE OF SOUND TRANSDUCERS

FIELD OF THE INVENTION

The invention relates to a process for developing a coating such as an exposed light-sensitive layer coated with a pattern or information on a length or plate of material through ultrasonic agitation.

A plate or length of material means here plates or lengths of metal or plastics such as an aluminium plate with an exposed light-sensitive layer which for instance may be used for printing, as well as printed circuit boards and silicon discs for electric circuits, and also including photographic films.

BACKGROUND ART

It is known to use ultrasound for improving the reaction speed when an exposed picture is to be developed and consequently is immersed in a bath of developer. The known apparatuses include one or more, usually many sound transducers mounted in such a manner in a tank with developer that the developer is caused to vibrate. A considerable power must be involved in order to provide the ultrasound in the known apparatuses with an essential influence on the reaction speed as the entire developer in the tank must be caused to vibrate.

SUMMARY OF THE INVENTION

It is accordingly an object of the invention to provide a process and a developing apparatus allowing a homogeneous and rapid, reliable developing of a picture, and which simultaneously is less expensive to use and manufacture than the known apparatuses.

According to the process of the invention the material is carried adjacent or at a short distance past a bar means extending substantially perpendicular to the advancing direction of the material and in the entire width of the information-carrying coating, said bar means being caused to vibrate by a plurality of sound transducers while a developer and/or the like processing liquids are applied, e.g. sprayed onto the coating in an area just in front of and adjacent the vibrating bar means in such a manner that the vibrations are transferred from the vibrating bar means to the developer and to a stripe-shaped, transverse area of the plate or the length with the coating. As a result, the material is caused to vibrate in an efficient manner along the entire portion being developed, i.e. the portion just provided with developer. Furthermore, the removable portion of the coating is loosened through the vibrations and washed off. Simultaneously it is no longer necessary to use a great tank with developer. By the process according to the invention the liquid or the developer can be fed through the intake of the distribution pipes and subsequently sprayed onto the material from said distribution pipes. From the material the liquid passes into a drain with a discharge pipe communicating with a tank and a pump. From the pump the liquid is again pumped towards the discharge pipe and leaves through the distribution pipes. The use of sound transducers mounted directly on a bar means allows a particularly efficient utilization of the ultrasonic energy provided.

By the process according to the invention the vibrations may be transferred through a direct, mechanical contact between the vibrating bar means and the material and/or through a thin layer of adherent developer, said adherent liquid originating from the sprayed developer or processing liquid. In this manner it is ensured that the sound vibrations are transferred exactly to the narrow, elongated area simultaneously subjected to the developer.

The invention furthermore relates to a developing apparatus for carrying out the process and comprising means for advancing and guiding the material as well as driving means for the advancing means. This apparatus is characterized in that one or more bar means are provided which extend substantially perpendicular to the advancing direction of the material in the entire width of the information-carrying coating and in close contact with the material and/or a thin layer of liquid thereon or at a short distance from the material, and that a number of sound transducers are mounted in acoustic contact on said bar means and are adapted to oscillate at one or more frequencies in the range 1–100 kHz, preferably piezoelectric ultrasonic transducers for about 40 kHz, and furthermore that distributor pipes including intake of developer and/or other processing liquids are provided, said distributor pipes extending parallel to or being coinciding with the bar means and further being adapted to apply, especially squirt liquid onto the material.

Such a developing apparatus ensures an efficient ultrasonic influence on the material at the same time as the apparatus is solid and simple and consequently inexpensive to manufacture and use. Only the portion of the developer having been in contact with the vibrating ultrasonically agitated pipe or already having hit the stripe of material currently developed is caused to vibrate by the ultrasonic transducers. Consequently, it is not necessary to involve an equally great power through the ultrasonic transducers as in connection with the known apparatuses using a great tank with ultrasonically agitated liquid.

The bar means is preferably a steel pipe or a steel profile, but any ultrasound-conducting material with suitable strength properties can be used.

The apparatus may according to the invention be provided with one or more bar means with a sound transducer at one end or a sound transducer at both ends of the bar means. In this manner the entire bar means can in a very simple manner be caused to vibrate. The bar means is preferably so long that the ends project outside the area wetted by the liquid-spraying distribution pipes. The transducers are mounted outside the above wet area which is preferably shielded. In this manner problems of encapsulating the transducers in order to protect them against liquid are avoided.

By the apparatus according to the invention the ultrasonic transducers may be adapted to operate at several different frequencies or be adapted in such a manner that the frequency varies over a predetermined frequency range. In this manner it is possible to counteract a possible tendency towards formation of standing waves on the bar which might involve a non-homogeneous agitation on the material. A corresponding effect can be obtained by varying the phase of one or more of the transducers.

The apparatus according to the invention may be provided with one set of ultrasonic transducers for each frequency. As the ultrasonic transducers and the adapting members used such as impedance transformers can be rather narrow-banded it is an advantage when each set is adjusted so as to operate to an optimum at a desired frequency.

BRIEF DESCRIPTION OF DRAWING

The invention will be described in greater details below with reference to the accompanying drawing, in which.

DESCRIPTION OF PREFERRED EMBODIMENTS

Figure 1:
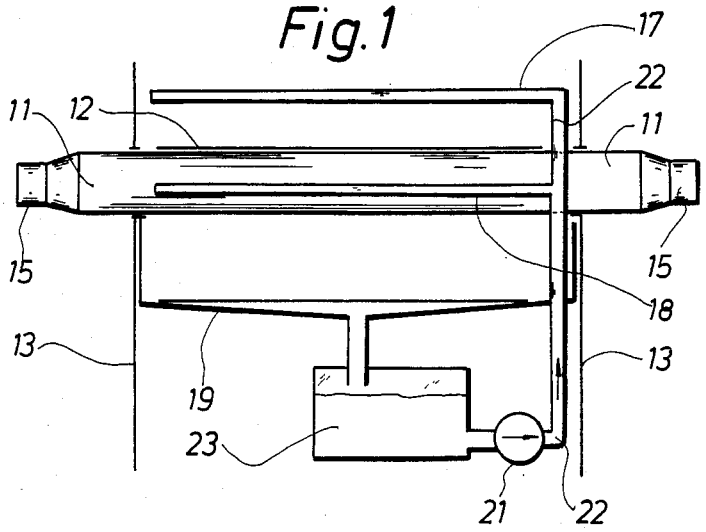
FIG. 1 is a diagrammatic view of an embodiment of a developing apparatus according to the invention.
Figure 2:
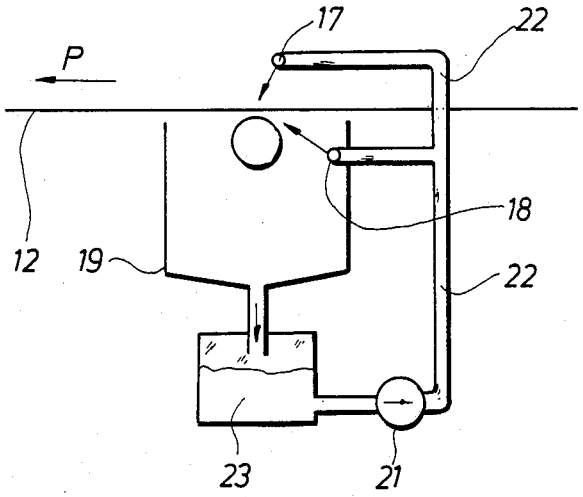
FIG. 2 is a longitudinal sectional view through the embodiment of FIG. 1.

FIGS. 1 and 2 are diagrammatic views of an embodiment of a developing apparatus according to the invention. The apparatus comprises a plurality of driving rollers or rolls not shown and possible freewheel rollers pulling and guiding the plate or length of material forwards through the apparatus.

A pipe 11 of steel is mounted transverse to the direction of feed of the plate material, cf. the arrow P of FIG. 2. The pipe 11 can also be made of other materials than steel, but the materials must possess a reasonable strength and the sound waves must be able to propagate in the material. According to the embodiment illustrated the pipe 11 projects outside the side walls 13 of the apparatus at both ends. Each end of the pipe 11 is provided with a transition member, i.e. an impedance transformer, and a piezoelectric ultrasonic transducer 15. The transducer 15 is connected to an electric circuit through conduits not shown, said circuit subjecting the transducer to a frequency in the range 1 kHz and 100 kHz. A frequency beyond the perceptile range is preferably used, and about 40 kHz is preferred. The electric circuit is preferably adapted to vary the frequency actuating the ultrasonic transducer. An air or water-cooling (not shown) can be provided for the transducer in order to protect it against a superheating. A temperature sensor (not shown) can be mounted in connection with the ultrasonic transducer and be connected to a control circuit implying an interruption of the current supply to the ultrasonic transducer in case of a superheating.

Two liquid distribution pipes 17, 18 are mounted adjacent the pipe 11. From the distribution pipe 17 the liquid is sprayed onto the upper surface of the plate 12, and from the distribution pipe 18 the liquid is sprayed onto the lower surface of the plate. Some of the liquid adheres as a thin film assisting in transferring ultrasound from the pipe 11 to the plate 12. By the developing apparatus of FIGS. 1 and 2 the plate 12 is advanced with the picture-producing coating facing upwards. As a result, the vibrating pipe 11 agitates the plate from below without causing scratches in the picture-producing coating. The developing is carried out by the liquid sprayed out from the pipe 17 reacting with the picture-producing film and washing off the superfluous material, the developing procedure and the loosening procedure being expedited by the ultrasonic vibrations.

The developing liquid sprayed out runs subsequently into a drain 19, from which it is carried through the discharge pipe 20 to a tank 23 and a pump 21. This pump returns the liquid to the distribution pipes 17, 18 through intakes 22.

In the illustrated embodiment the distribution pipes 17, 18 are steel pipes provided with a row of holes drilled therein at regular intervals. Having passed these holes the liquid flows towards the plate 12. The distribution pipes 17, 18 may, however, also be provided with one or more longitudinal grooves allowing a spraying out of liquid therethrough as a continuous "carpet" towards the plate 12. Furthermore, the pipe may be manufactured completely or partially of a porous material such as sponge optionally in direct contact with the plate 12.

Figure 3:
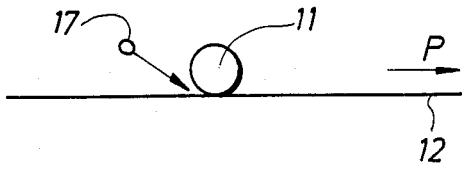
FIG. 3 illustrates a detail of a second embodiment of a developing apparatus.

According to a particularly simple embodiment, cf. FIG. 3, only one liquid distribution pipe 17 and only one vibration-carrying pipe 11 are involved, the vibrations being transferred in the developer on the coated side of the plate 12.

Figure 4:
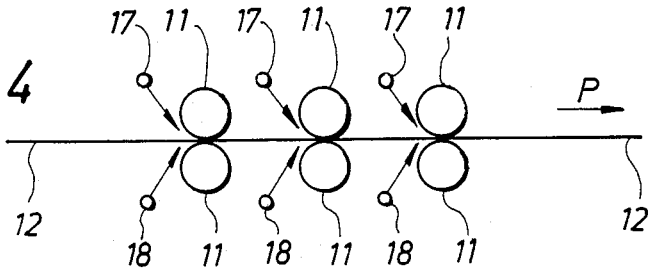
FIG. 4 illustrates a third embodiment of a developing apparatus according to the invention.
Figure 5:
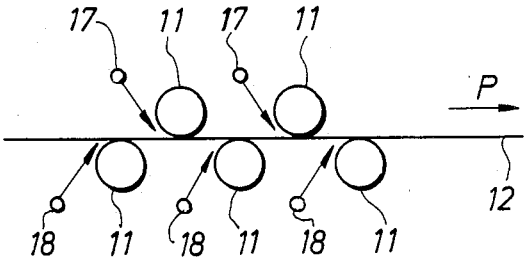
FIG. 5 illustrates a further embodiment according to the invention.

According to a preferred embodiment the apparatus is provided with several vibrating pipes or bars 11, cf. FIG. 4, both above and below the plate 12. A set of liquid distribution pipes 17, 18 can be provided for each set of bars 11. The use of two opposing pipes, of which at least one is caused to vibrate by means of ultrasound, ensures a heavy influence of the plate. As illustrated in FIG. 5, the bars may also be staggered. An increase of the number of vibrating bars allows an increase of the advancing speed of the material through the developing apparatus. Furthermore, the ultrasonic transducers on the various bars can be adjusted for different frequencies.

The bars may be caused to vibrate independently of one another in such a manner that the bars vibrate at various frequencies or in such a manner that some of the bars are idle.

One or more of the vibrating bars may be shaped as rolls and be pivotably mounted optionally in connection with driving means.

The vibrating bars may be provided with an advantageous coating such as a resilient rubber mass or be provided with brushes.

Figure 6:
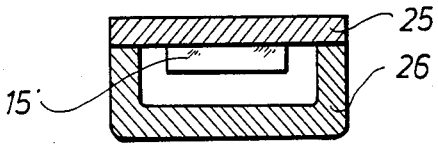
FIG. 6 illustrates an embodiment of a bar means for a developing apparatus.

A vibrating plate such as a flat bar or a sectional iron, cf. for instance FIG. 6, can be used instead of pipes. Then the ultrasound-transferring portion of the bar is shaped as a flat bar 25. Below the flat bar a flat U-shaped profile 26 is welded thereon. It is possible to build ultrasonic transducers into this embodiment in such a manner that they are for instance positioned within the bar-shaped means. In connection with particularly great developing apparatuses for developing plates of a very great width, it can be a desire to allow a mounting of several ultrasonic transducers along the vibrating bar means. Such transducers must preferably be mounted in such a manner that they are protected against the developer sprayed out. Such a protected positioning is obtained by means of the embodiment of FIG. 6.

Figure 7:
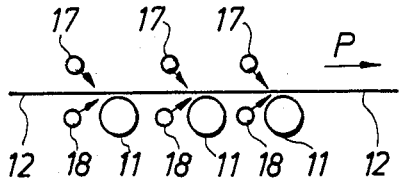
FIGS. 7 and 8 illustrate further embodiments.
Figure 8:
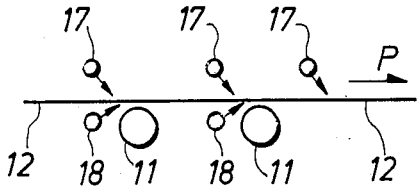

FIGS. 7 and 8 show examples of other embodiments including more bars 11 and more liquid distribution pipes 17, 18, each bar and each distribution pipe being positioned in the same manner as in FIGS. 1 and 2 and having the same function as described in connection with FIGS. 1 and 2.

Figure 9:
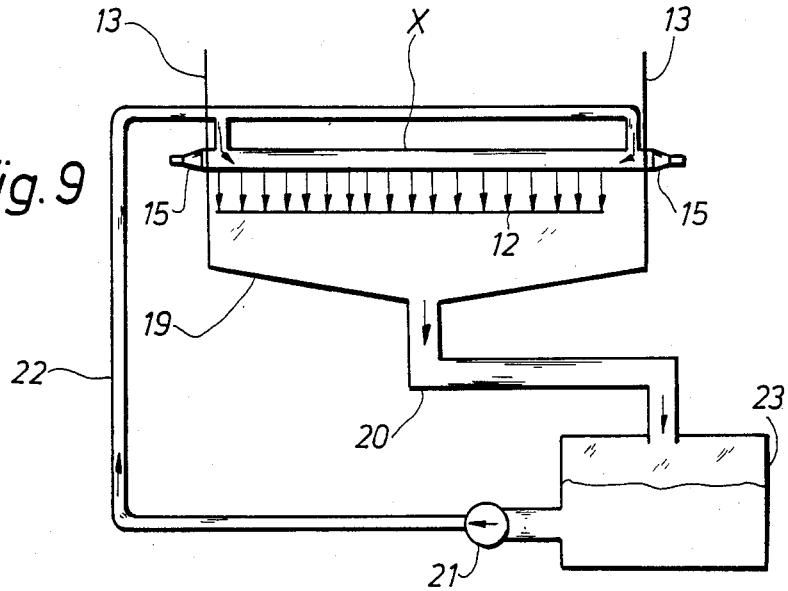
FIG. 9 illustrates an additional embodiment of a developing apparatus according to the invention.
Figure 10:
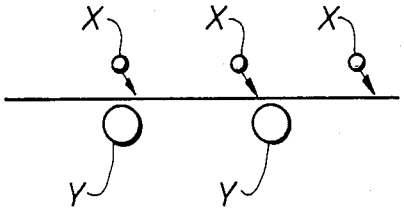
FIG. 10 is a diagrammatic sectional view through a detail of the embodiment of FIG. 9.

Furthermore FIGS. 9 and 10 illustrate an embodiment of the developing apparatus according to the invention. The same reference numerals have been used in these FIGURES as previously for the same members having the same function as described previously. Unlike the remaining embodiments the distribution pipe of FIGS. 9 and 10 coincides with the bar means, i.e. the steel pipe, in such a manner that the pipe X of this embodiment functions both as a distribution pipe or spraying pipe and as vibration-transferring pipes. The pipe X is the bar means provided with ultrasonic transducers and communicates simultaneously with the inlet pipe 22. From this inlet pipe 22 the developer enters the pipe X provided with a plurality of openings, which the ultrasonically agitated developer passes towards the material 12 and thereby agitates the material ultrasonically, cf. the downward arrows of FIG. 9. FIG. 10 is a sectional view through a detail of the embodiment of FIG. 9. It appears that for instance three ultrasonically agitated distribution pipes X may be present, and a set of transport rolls Y may be provided below the material 12. In this embodiment these transport rolls have nothing but a transport and supporting function. In this embodiment the three bars may be provided with ultrasonic transducers adjusted for differing frequencies.

It is obvious to a person skilled in the art that the apparatus may be altered in many ways without thereby deviating from the scope of the invention as described in the following claims.

We claim:

1. A method of developing an exposed light-sensitive layer on a length of material, comprising the steps of:

advancing the length of material in a predetermined direction past a bar extending substantially perpendicular to said predetermined direction;

vibrating said bar with a plurality of sound transducers; and applying a layer of developer to the length of material adjacent the bar so that vibrations are transferred from the bar to the developer and to an area of the length of material adjacent the bar;

wherein the vibrations are transferred through direct mechanical contact between the vibrating bar and the length of material.

2. A method of developing an exposed light-sensitive layer on a length of material, comprising the steps of:

advancing the length of material in a predetermined direction past a bar extending substantially perpendicular to said predetermined direction;

vibrating said bar with a plurality of sound transducers; and applying a thin liquid layer of developer to the length of material adjacent the bar so that vibrations are transferred from the bar to the developer and to an area of the length of material adjacent the bar;

said thin liquid layer being of sufficient thickness to contact the bar so that vibrations are transferred through the thin liquid layer between the vibrating bar and the length of material.

3. Apparatus for developing an exposed light-sensitive layer on a length of material, comprising:

means for advancing and guiding the length of material in a predetermined direction;

bar means extending transversely of said predetermined direction in direct contact with the material;

sound transducer means mounted in acoustic contact on said bar means, said sound transducer means being capable of oscillating at least one frequency in the range of 1–100 kHz; and spray means for applying a thin layer of developer to said length of material adjacent said bar means so that said thin layer contacts the bar means and is vibrated thereby with the bar contacting a transverse part of said length of material.

4. Apparatus in accordance with claim 3 wherein said sound transducer means comprises an ultrasonic transducer mounted at one end of the bar means.

5. Apparatus in accordance with claim 3 wherein said sound transducer means comprises ultrasonic transducers mounted both ends of the bar means.

6. Apparatus in accordance with claim 4 further comprising a pair of sidewalls, the spray means being within said sidewalls, the ultrasonic transducer being outside said sidewalls.

7. Apparatus is accordance with claim 3 wherein said sound transducer means comprises a plurality of ultrasonic transducers operating at a predetermined number of frequencies.

8. Apparatus in accordance with claim 7 wherein said plurality of ultrasonic transducers comprises at least one transducer for each of said frequencies.

9. Apparatus in accordance with claim 7 further comprising means for varying the phase of at least one of said transducers.

10. Apparatus for developing an exposed light-sensitive layer on a length of material, comprising:

means for advancing and guiding the length of material in a predetermined direction;

bar means extending transversely of said predetermined direction in almost direct contact with the material;

sound transducer means mounted in acoustic contact on said bar means, said sound transducer means being capable of oscillating at at least one frequency in the range of 1–100 kHz; and spray means for applying a thin layer of developer to said length of material adjacent said bar means so that said thin layer contacts the bar means;

said bar means transferring vibrations through the thin layer of developer to a transverse part of said length of material.

* * * * *

UNITED STATES PATENT AND TRADEMARK OFFICE

CERTIFICATE OF CORRECTION

PATENT NO. : 4,652,106

DATED : March 24, 1987

INVENTOR(S) : Peter J. Jurgensen et al

It is certified that error appears in the above-identified patent and that said Letters Patent is hereby corrected as shown below:

Column 3, lines 3-4, "Drawing" should read -- Drawings --.
Column 3, line 6, "drawing" should read -- drawings --.
Column 6, line 25, after "mounted" insert -- at --.

Signed and Sealed this

First Day of September, 1987

*Attest:*

*Attesting Officer*

DONALD J. QUIGG

*Commissioner of Patents and Trademarks*